US006460693B1

(12) United States Patent
Harrold

(10) Patent No.: US 6,460,693 B1
(45) Date of Patent: Oct. 8, 2002

(54) CHILD RESISTANT BLISTER PACK CONTAINER WITH COMPOUND ACTION RELEASE MECHANISM

(75) Inventor: John E. Harrold, Bloomsbury, NJ (US)

(73) Assignee: Valley Design, Inc.

( * ) Notice: Subject to any disclaimer, the term of this patent is extended or adjusted under 35 U.S.C. 154(b) by 0 days.

(21) Appl. No.: 09/314,407

(22) Filed: May 19, 1999

(51) Int. Cl.[7] ..... A45C 13/10; B65D 83/04; B65D 43/12

(52) U.S. Cl. ..... 206/1.5; 206/531; 220/345.3

(58) Field of Search ..... 206/1.5, 531, 539, 206/807; 220/345.3, 345.2, 345.1, 348

(56) References Cited

U.S. PATENT DOCUMENTS

| | | | | | |
|---|---|---|---|---|---|
| 1,994,063 | A | * | 3/1935 | Bruns et al. | 220/345.3 X |
| 2,708,026 | A | * | 5/1955 | Duell | 220/345.3 X |
| 3,429,426 | A | | 2/1969 | Wolf et al. | |
| 3,888,350 | A | | 6/1975 | Horvath | |
| B 536,923 | | | 3/1976 | Mayled | |
| 3,942,630 | A | | 3/1976 | Phillips | |
| 3,987,891 | A | * | 10/1976 | Horvath | 206/1.5 |
| 4,113,098 | A | * | 9/1978 | Howard | 206/1.5 X |
| 4,113,332 | A | | 9/1978 | McMaster | |
| 4,174,034 | A | * | 11/1979 | Hoo | 206/1.5 |
| 4,187,703 | A | * | 2/1980 | Ippoliti et al. | 206/1.5 X |
| 4,192,422 | A | | 3/1980 | Kotyuk | |
| 4,401,210 | A | * | 8/1983 | Anjou | 206/1.5 |
| 4,485,915 | A | | 12/1984 | Berghahn | |
| 4,561,544 | A | * | 12/1985 | Reeve | 206/1.5 X |
| 4,817,819 | A | | 4/1989 | Kelly | |
| 5,082,137 | A | | 1/1992 | Weistein | |
| 5,251,757 | A | * | 10/1993 | Relyea et al. | 206/531 |
| 5,275,291 | A | | 1/1994 | Sledge | |
| 5,368,187 | A | | 11/1994 | Poncetta et al. | |
| 5,377,839 | A | | 1/1995 | Relyea et al. | |
| 5,878,887 | A | | 3/1999 | Parker et al. | |

* cited by examiner

*Primary Examiner*—Bryon P. Gehman
(74) *Attorney, Agent, or Firm*—Kenneth P. Glynn

(57) ABSTRACT

The present invention is a child resistant safety container for a blister pack with a housing with an opening in which a drawer which contains the blister pack can be inserted. A latching mechanism is provided to engage and retain the drawer when inserted into the housing. The latching mechanism has cooperating male and female parts located on the drawer and the housing in positions complimentary to each other. The part located on the housing is functionally operable with a latching trigger slidably connected to the housing. Resilient living springs are provided to urge the drawer into latching engagement and, when the drawer is pushed in against the spring, moves to partially disengage the drawer. The latching trigger moves the latching mechanism into a second position fully disengaging the drawer for removal.

20 Claims, 6 Drawing Sheets

A-A

B-B

C-C

D-D

E-E

F-F

G-G

H-H

CHILD RESISTANT BLISTER PACK CONTAINER WITH COMPOUND ACTION RELEASE MECHANISM

BACKGROUND OF THE INVENTION

1. Field of the Invention

The present invention is a child resistant safety container with a stored drawer of a medicine dispensing blister pack. A compound motion, involving pushing the drawer inward, combined with moving a latching trigger located on the exterior of the safety container, is require to release the drawer containing the blister pack.

2. Information Disclosure Statement

U.S. Pat. No. B 536,923 to Edward Mayled describes a package having an improved means for releasably retaining the components of the package in assembly. Known similar package constructions require the use of additional material and necessitate the performance of additional manufacturing operations in order to provide closure flaps situated at opposite ends of a sleeve which is adapted to support a removable tray therein. The package according to the subject invention is of relatively simple construction, as well as being more economical than known similar packages. According to the subject invention, the improved package comprises a container and an enclosure having at least one open end. The container is adapted to be inserted into or removed from the enclosure through at least one open end thereof. The container and the enclosure are of substantially equal dimension and have cooperating means adapted to provide a positive connection between the container and the enclosure whereby the container is releasably retained within the enclosure until the cooperating means are disengaged by a user.

U.S. Pat. No. 3,429,426 to Otto Wolf and Otto Weller describe a package for discrete articles. An outer sleeve of substantially rectangular cross-section has at least one open end. An inner receptacle is slidably received in the outer sleeve and comprises a first member which has a side provided with at least one open recess, and a second recess which overlies this side and is sealingly connected to the first member so as to define with this open recess a sealed chamber within which an article to be packaged is to be accommodated.

U.S. Pat. No. 3,888,350 to William Horvath describes a snap lock and squeeze open slide top container that has a small centered catch depending from the inner face of the cover. The edge of the catch forms with the closed end of the cover a slot which accommodates the rear edge of the drawer portion of the container. The profile of the catch is tapered, forming an inclined plane directed to the front end of the container. The cover and drawer are slidably engaged by lateral meshing flanges which are interrupted near the closed end to provide slight clearances between the inside of the cover and the outside of the drawer. These clearances, together with an inverted V-shaped cut centered in the rear skirt of the cover, permit the cover to bow up when the sides are squeezed, releasing the edge of the drawer portion from the slot formed by the catch, to open the drawer. When the drawer is closed, the edge portion rides forward along the inclined plane depending from the cover, engaging the slot with a click, to lock the container closed. To prevent spillage, the opening of the drawer is limited by a pair of small stops depending from the inner face if the cover near each sidewall, which ride in elongated recesses in the lateral walls.

U.S. Pat. No. 3,942,630 to Otto Phillips describes a sliding cover safety package including a container having a cover mounted thereon for slidable movement between open and closed positions with respect to the container. The container and cover are provided with locking lugs having a locked position when the cover is closed in which the cover is locked against movement from its closed position with respect to the container, and an unlocked position when the cover is closed in which the cover is locked against movement from its closed position with respect to the container, and an unlocked position when the cover is closed in which the cover can slide with respect to the container to its open position. The locking lugs are moveable between the locked and unlocked positions by axial movement of the cover with respect to the container. Resilient biasing members is engaged between the container and cover to bias the locking lugs to the locked position such that the cover can slide from its closed position with respect to the container only after axial movement of the cover with respect to the container against the biasing members.

U.S. Pat. No. 4,113,332 to James David McMaster describes a secret compartment case having a flexible housing, an inner drawer and an outer drawer, the flexible housing having a release member formed therewith for operatively connecting the inner drawer with the housing, the inner drawer being releasable from the housing to allow movement from a secured to an unsecured position when the outer drawer is moved from the shut position.

U.S. Pat. No. 4,192,422 to Bernard Kotyuk describes a pill package of the type including child-proof features makes use of the standard blister card for mounting the pills. A plastic shield is constructed to provide a slidable mating relationship with the blister card in an unlocked position and the car and shield together defining locking means wherein both locked and unlocked positions can be assumed between the card and the shield. As in all conventional blister cards, an access means construction is included, but in the structure of the present invention, the access means is unexposed when the card and shield are in the locked position.

U.S. Pat. No. 4,485,915 to Walter G. Berghahn describes a child resistant package having an outer container and an inner product supporting tray; the inner tray is adapted to be inserted into the container to a locked position and removed therefrom by disengaging a locking means and withdrawing the tray; the inner tray is disengaged from the container by pressing inwardly a pair of flexible tabs formed at the back end of the side walls of the tray; in a preferred embodiment a blister pack containing tablets is disposed on the product tray and the tray bottom is provided with holes through which the tablets in the blister pack may be pushed.

U.S. Pat. No. 4,817,819 to Thomas K. Kelly describes a tablet container having a cover and a sliding tray is used for dispensing birth control tablets for either a twenty-one-day ar twenty-eight-day cycle. Normally, the tray does not slide completely out of the cover and is stabilized with respect thereto when open. The case resembles a cosmetics compact and is reusable in that once birth control tablets contained in a blister pack are used up, a new blister pack may easily be inserted.

U.S. Pat. No. 5,082,137 to Jack Weinstein describes an invention directed toward a child resistant locking slide box that is opened by deforming a locking tab on the slide box drawer that positively engages the surrounding cover. There are tracks on the inside surfaces of the cover side walls that positively engage and slide along tracks positioned on the outside surfaces of the drawer side walls. The engagement of the cover and draw tracks allow only for the respective lateral movement of the cover across the drawer. The lateral movement of the cover allowed by the tracks is restricted in one direction by the cover end tabs, and in the other direction by the drawer lockin tab.

The drawer locking tab has a step that overlaps the cover surface. To open the slid box the cover tab must first be deformed backward, removing the step from above the cover, and then downward so that the whole locking tab is beneath the cover. Once the draw tab is below the cover, the drawer can be pushed past the cover, exposing the contents of the drawer.

U.S. Pat. No. 5,275,291 to Larry C. Sledge describes a child-resistant, elderly friendly dispensing container which comprises a housing having an opening in its top wall and a drawer which slidably fits into the housing. The drawer has a front cavity section and a rear latch section. The latch section includes a horizontally disposed resilient panel formed with an upward button which, when the drawer is closed, extend up through the opening in the top wall of the housing and forms an automatic latch, holding the drawer closed. In order to open the drawer, the button bust be depressed and, at the same time, the drawer must be pulled out from the housing. The top of the housing is formed, adjacent the opening for the button, with a relief zone into which the button moves when the drawer is in dispensing position and blocks further opening.

U.S. Pat. No. 5,368,187 to Stanley Poncetta et al describes a dispenser and method for dispensing material from a blister pack of one or more blister cards. A single blister card having a plurality of blisters thereon can be used with other blister cards in a stack. To dispense materials from the aligned blisters of stacked blister cards, a plunger is driven through a guide hole in a top plate and into aligned blisters of a stack of blister cards. In this way, a plurality of blisters can be quickly and cleanly opened. Thus, a plurality of medical pills can be liberated from the blister and can easily gravitate to a collection region below the stack of blister cards. Several embodiments of the mount for the blister card stack is disclosed.

U.S. Pat. No. 5,377,839 to Chrystopher M. Reylea et al describes an improved exchangeable medicament dosing system and method which includes a reusable integral patent dispensing frame which supports a plurality of reusable cartridges. Replaceable blister packages having a plurality of individually sealed spaced pockets are slidably inserted into the reusable cartridge and aligned with a predetermined number of dispensing openings therewhithin. The blister packages are specifically designed to mechanically interact with the cartridge as they are slidably inserted to properly align the spaced pockets with corresponding dispensing openings of the cartridge. One or more cartridges are releasably locked at least partially within the dispensing frame, and a plurality of dispensing frames can be placed in a frame container for convenient exchange and use with medication carts. The resulting dosing system and method combines the advantages of punch card distribution with its excellent visual accountability and seal, with the benefits of a perpetual inventory exchange system.

U.S. Pat. No. 5,878,887 to Kathleen Alek Parker et al describes a child-resistant blister package having a tray adapted to receive a blister card with at least one blister compartment is provided. The tray includes a first slide component. A cover having a top and a second slide component is provided. The second slide component is complimentary to and slidingly engaged with the first slide component. The second slide component is connected to the top of the cover such that the cover can be slidably displaced relative to the tray between the first position, in which the top of the cover substantially overlies the tray and is adapted to prevent access to the blister card, and a second position, in which the cover is displaced at least partially from the tray such that the blister card is exposed. A tab is connected to the cover, and one of a locking projection and a slot is located on the tab. The other of the slot and the locking projection is located on a first portion of the tray in a complimentary location to the locking projection when the cover is in the first position, such that the locking projection is engaged in the slot to limit relative movement of the cover with respect to the tray. One of the tab and the first portion of the tray is movable to a position in which the locking projection is disengaged from the slot to permit movement of the cover to the second position.

Notwithstanding the prior art in this field, it is believed that the present invention which teaches is neither taught nor rendered obvious.

SUMMARY OF THE INVENTION

The present invention is a child resistant safety container for a blister pack comprising a housing with at least one open side which positions and retains a drawer inserted into the open side of the housing. A latching means to engage and retain the drawer when inserted into the housing is provided which has cooperating male and female parts. One of the male and female is parts located on an outside surface of the drawer and the other part is located on the inside of the housing in a position complimentary to the outside surface the drawer and functionally operable with the latching means part on the outside surface of the drawer. A latching trigger member is slidably connected to the housing in a position to functionally connect to and actuate one of the latching means male and female parts located on the inside of the housing. The latching means includes a first resilient means to urge the drawer into engagement with the latching means and, when said drawer is pushed in against the first resilient means, moves the latching means into a first partially disengaging position. The latching trigger member then moves latching means against a second resilient means in into a second fully disengaging position allowing the drawer to be removed from the safety container.

BRIEF DESCRIPTION OF THE DRAWINGS

The present invention should be more fully understood when the specification herein is taken in conjunction with the drawings appended thereto; wherein.

DETAILED DESCRIPTION OF THE PRESENT INVENTION

The present invention is a child resistant safety container for a blister pack.

Blister packs are commonly used to dispense medicines, and need to be protected from unsupervised access by children and others. In this invention a blister pack can be safely stored in a container. Release of the blister pack from the safety container requires a compound motion not obvious to an untrained user of the safety container.

A safe blister pack container of this type will be useful in situations where larger amounts of medicines are distributed such as hospitals, clinics, nursing homes, doctors offices, and veterinary or other animal care facilities. The blister pack can be stored in this tamper resistant container and then easily released for use by a trained user of the safety container.

A drawer is used which is inserted into the safety container through one open end surface. The drawer is guided into the safety container housing by the top, bottom and side surfaces of the container. An internal latching mechanism inside the safety container engages and retains the drawer inside the housing when the drawer is inserted.

Two sets of resilient living springs are provided which maintain the position of the drawer during insertion of the drawer, and control operation of the latching mechanism which retains and releases the drawer.

When the drawer is fully inserted, the springs urge the drawer into engagement with the latching mechanism. Then, a compound motion is required for release of the drawer. To release the drawer, the drawer is first pushed into the housing against a first set of living springs included in the assembly. This action positions the latch mechanism into a first partially disengaged position. Then a trigger latching member located on the outside of the housing, which is positioned to cooperate with the drawer, is moved to fully disengage the drawer from the latching mechanism against the second set of living springs included in the assembly. The drawer is then released from the safety container.

Figure 1:
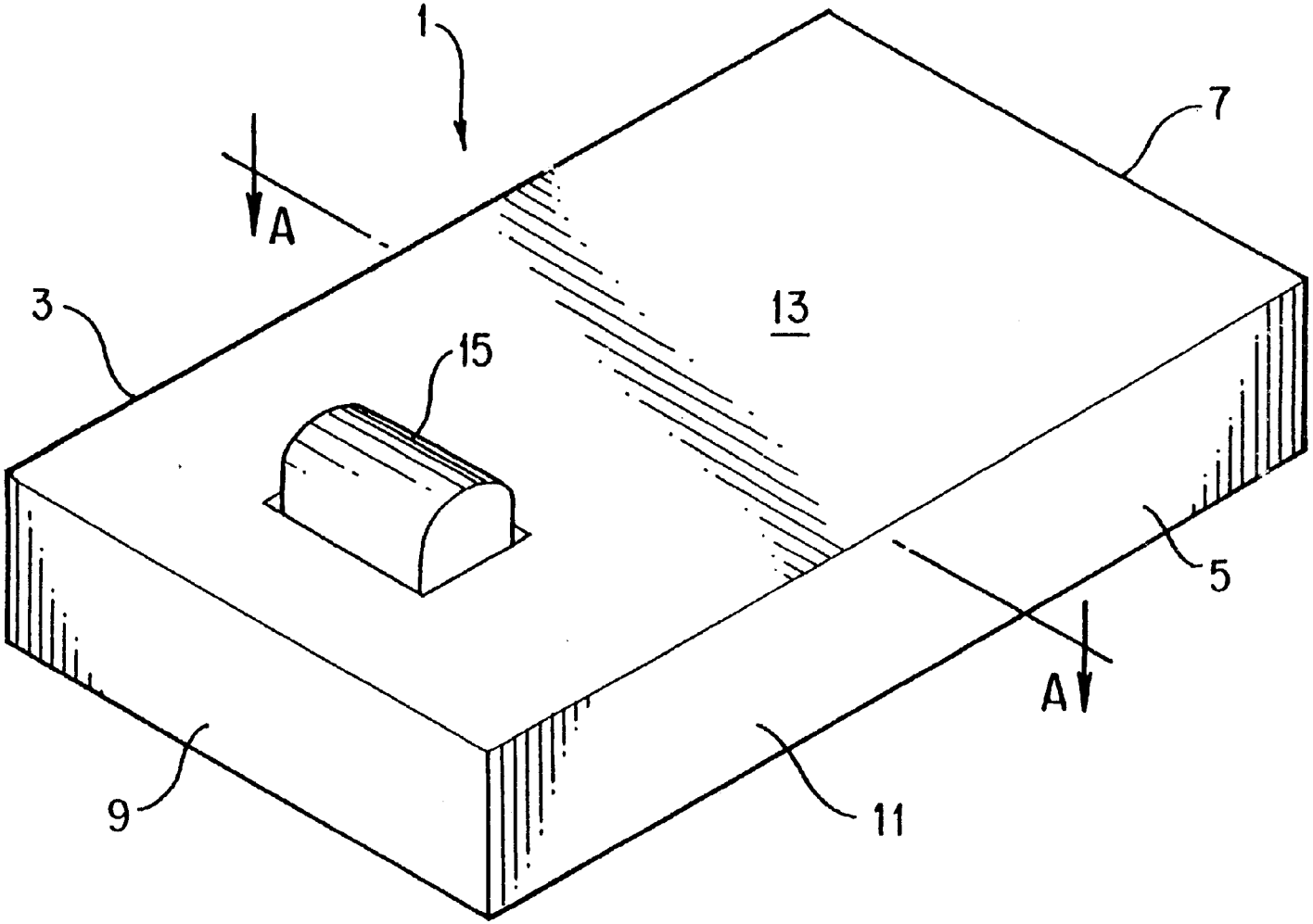
FIG. 1 is a top perspective view of one embodiment of a present invention child resistant blister pack container.
Figure 7:
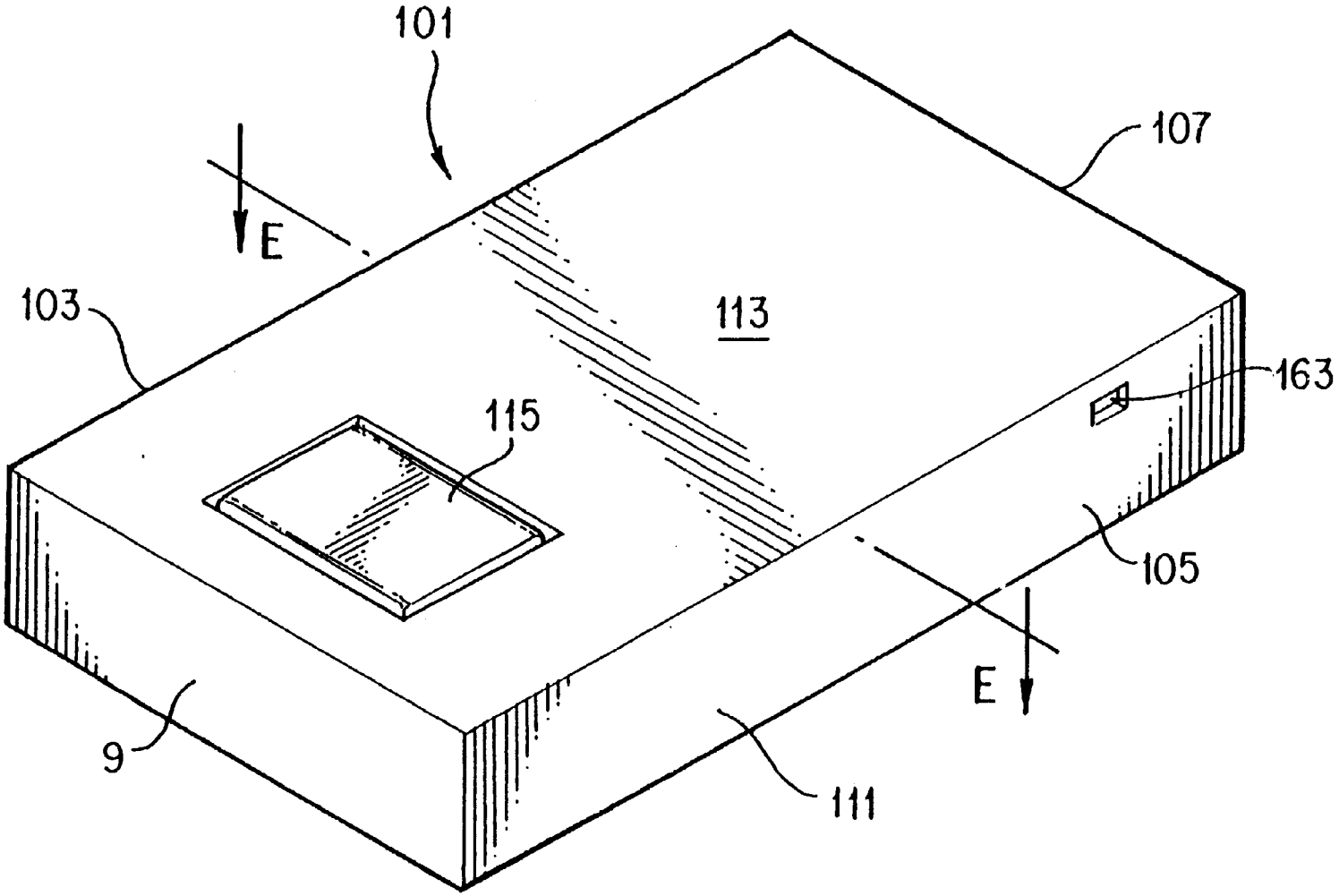
FIG. 7 is a top perspective view of another embodiment of a present invention child resistant blister pack container.

In the embodiments shown herein on FIGS. 1 and 7, the latch mechanism is a female part which is a pin projecting from the side of a bracket integral with the back of the housing, and a male part which is a hook attached to the drawer and configured to cooperate with the pin for engagement, retention, and release of the drawer.

The first embodiment of this invention shown is detailed in FIGS. 1 through 6 with like elements or components being like numbered.

Figure 2:
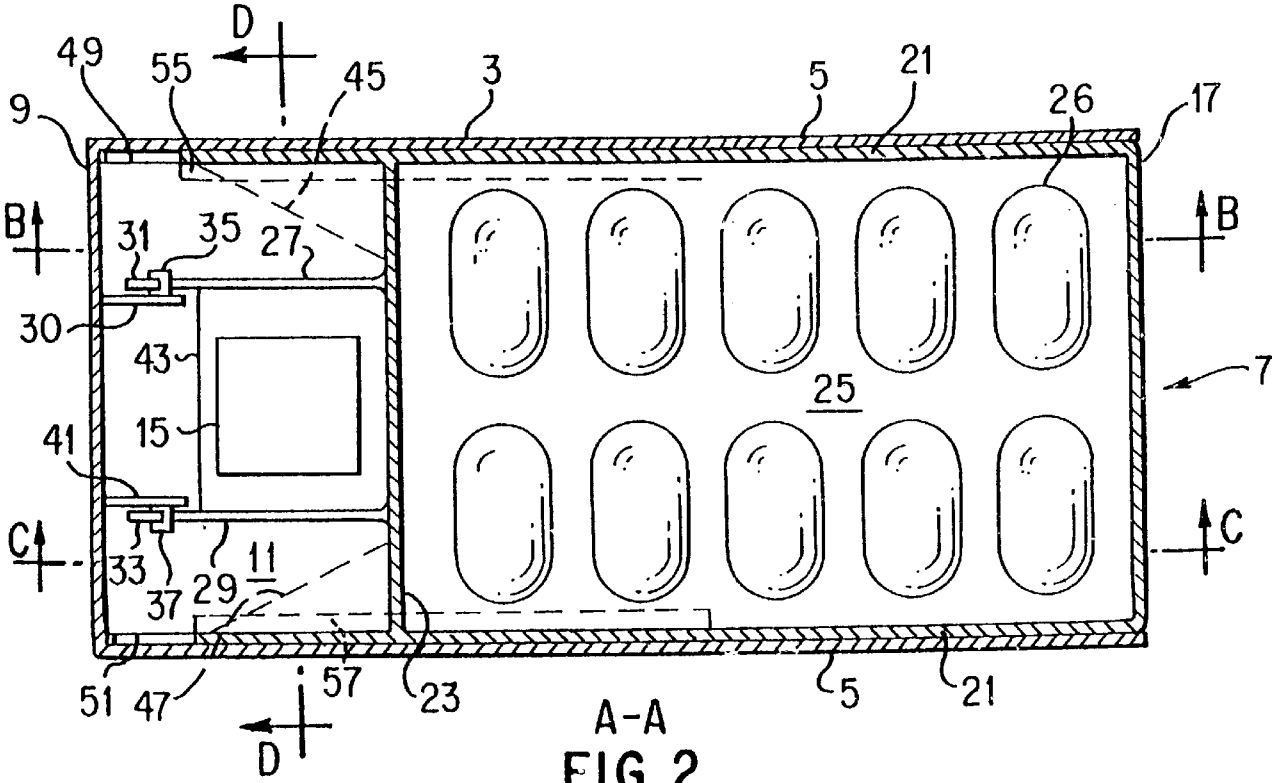
FIG. 2 is a top cut sectional view of the present invention container shown in FIG. 1.
Figure 3:
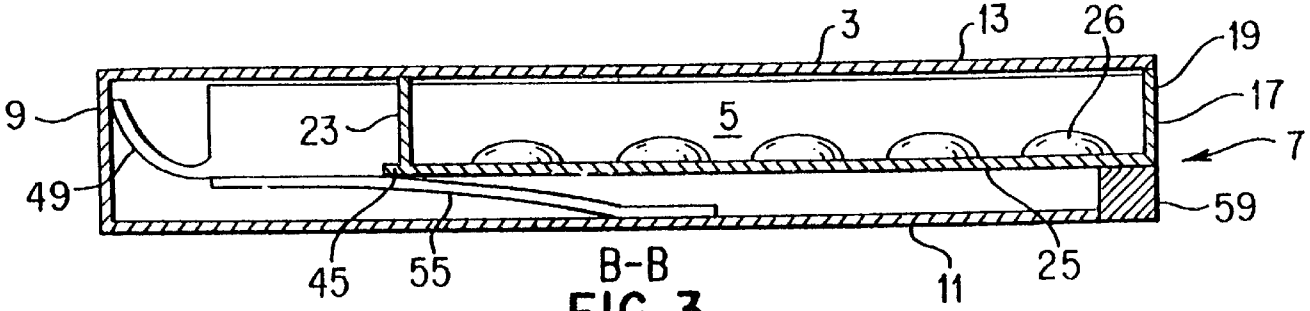
FIGS. 3 and 4 are a left side cut view and a right side cut view, respectively, of the present invention container shown in FIGS. 1 and 2.
Figure 4:
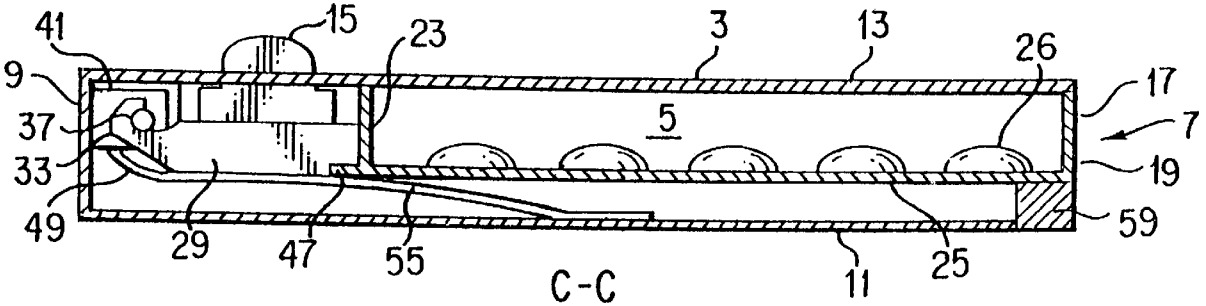
Figure 6:
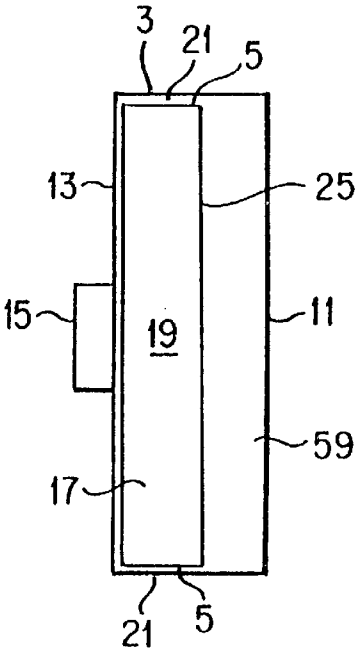
FIGS. 5 and 6 are a cut end view and an end view respectively, of the present invention container shown in FIGS. 1 through 4.
Figure 5:
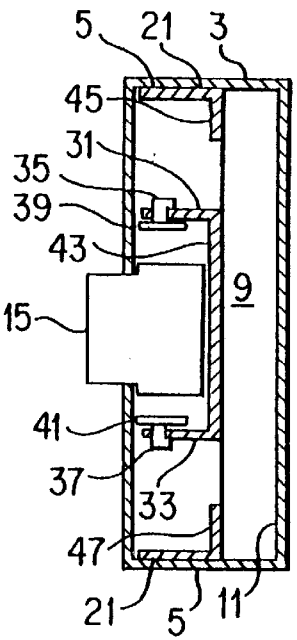

FIG. 1 shows a top perspective view and additional section views for further description of the invention are shown at A—A, FIG. 2, at B—B, FIG. 3; at C—C, FIG. 4; and at D—D, FIG. 5; and, FIG. 6 is an end view of the front of the safety container of FIG. 1. These Figures are described collectively. FIG. 1 is a perspective view of the exterior of the safety container 1 showing the housing 3; the sides 5, the open front 7 where the drawer is inserted into the container (not show in the perspective view), back 9, bottom 11, and top 13 of the housing; and latching trigger 15 operable from the exterior of the container.

FIG. 2 is section view of the perspective view of container 1 at A—A. Drawer 17 is shown fully inserted into container 3 through open front 7. Drawer 17 has front 19, bottom 25, sides 21, and back 23, with blisters 26 containing medicines or the like. Attached to the back 23 of drawer 17 are rearward supports 27 and 29 which extend to hooks 31 and 33. Hooks 31 and 33 are shown engaged with pins 35 and 37, which are supported on brackets 39 and 41 which are integral with back 9 of housing 3. Latching trigger 15 rests on shelf 43, of drawer 17, which is connected to back 23, rearward supports 27 and 29, and back 23 of the drawer. Drawer 17 also has integral triangular members 45 and 47 which support rearward extensions of sides 21 and living springs 49 and 51, which in this embodiment are shown integral with sides 21 of drawer 17. Living springs 55 and 57 are shown attached to the inside surface of bottom 11 and resting on sides 21 of drawer 17. The bottom 11 of drawer 17 rests on lip 59 formed on bottom 11 of housing 3 at the front of the housing.

When the drawer 17 is inserted into housing 3, it is guided by lip 59, top 13, and sides 21 of the housing rearward to engagement with living springs 55 and 57. Further rearward movement of drawer 17 causes living springs 49 and 51 to engage rear surface 9 of the housing 3. Also, hooks 31 and 33 engage pins 35 and 37, and acting against living springs 55 and 57, snap into engaged position with the pins. The tension of living springs 49 and 51 maintain engagement of the hooks 31 and 33 with pins 35 and 37.

The compound motions of pushing drawer 17 inward into housing 3 and pushing latching member 15 downward into housing 3 are required to release the drawer from the housing. Pushing drawer 17 inward against living springs 49 and 51 moves hooks 31 and 33 rearward into a first nonengaged position with pins 35 and 37. Then, pushing latching member 15 downward against shelf 43 causes drawer 17 to rock downward, about lip 59 at the front of housing 3, against living springs 55 and 57, moving hooks 31 and 33 downward to a second position out of engagement with pins 35 and 37 allowing the drawer 17 to be removed from housing 3.

The second embodiment of this invention shown is detailed in FIGS. 7 through 12 with like elements or components being like numbered.

Figure 8:
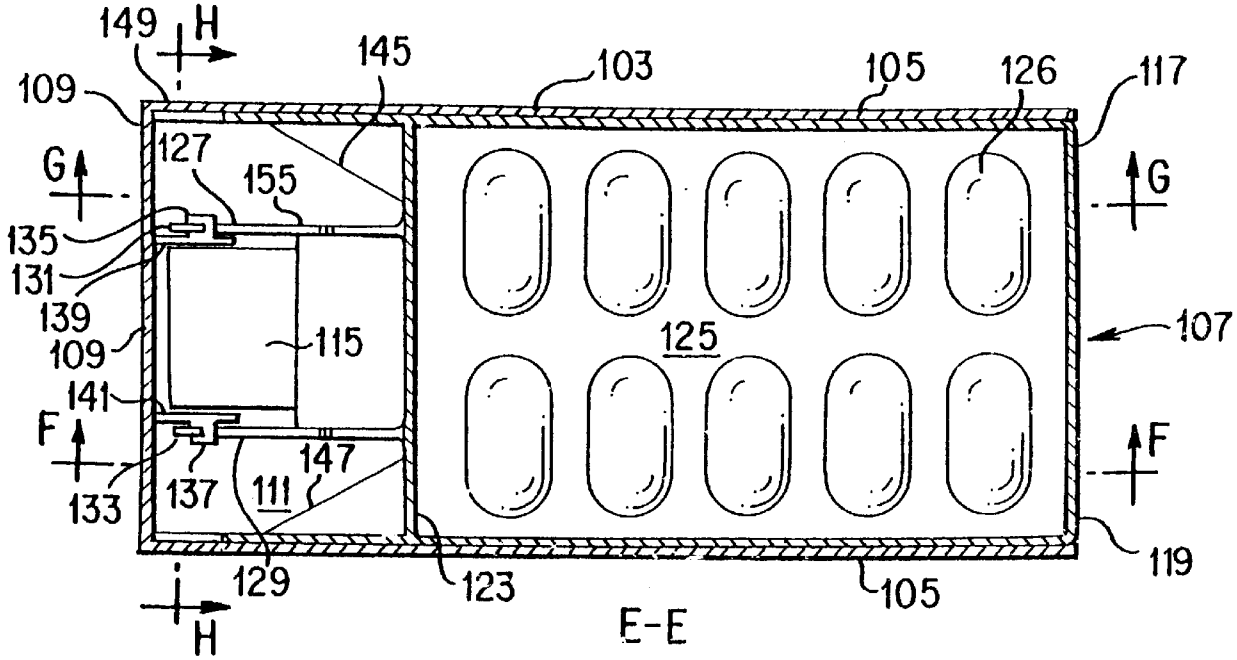
FIG. 8 is a top cut sectional view of the present invention container show in FIG. 7.
Figure 9:
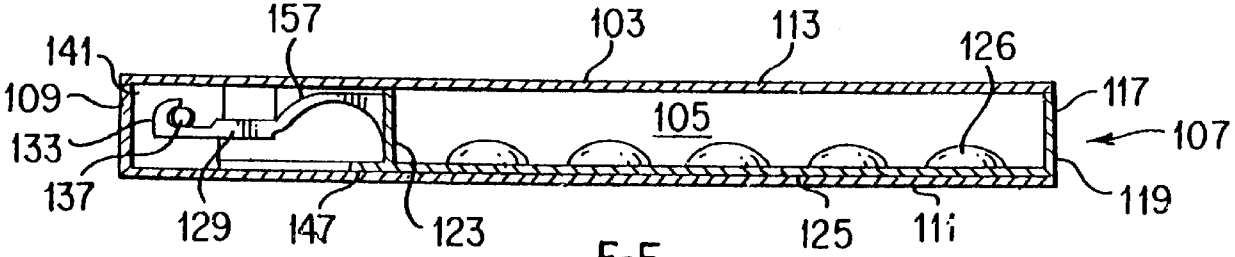
FIGS. 9 and 10 are a left side cut view and a right side cut view, respectively, of the present invention container shown in FIGS. 7 and 8.
Figure 10:
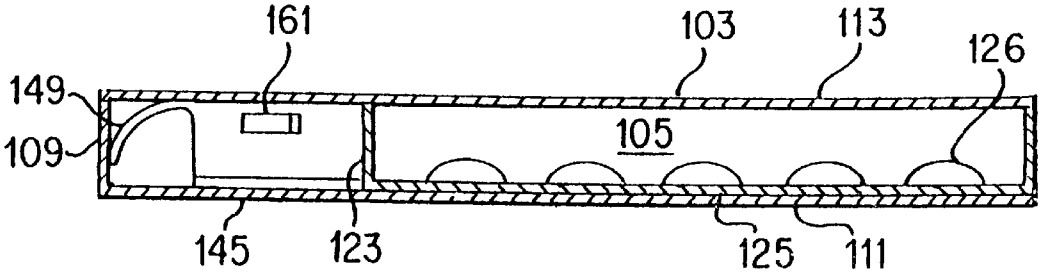
Figure 13:
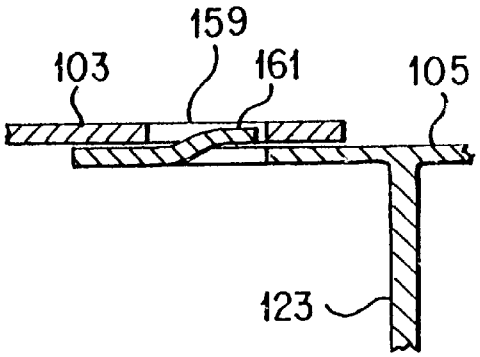
Figure 12:
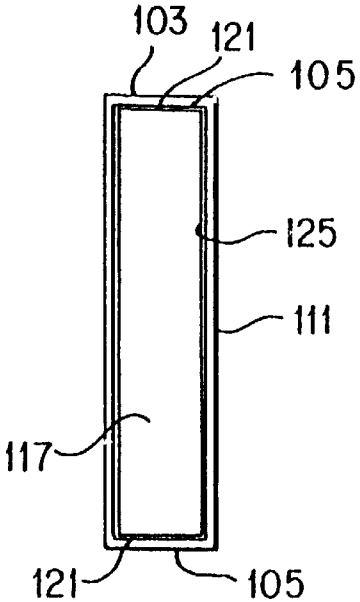
FIGS. 11 and 12 are a cut end view and an end view respectively of the present invention container shown in FIGS. 7 through 10; and, FIG. 13 is a partial side cut view of a portion of the present invention container shown in FIGS. 7 through 12.
Figure 11:
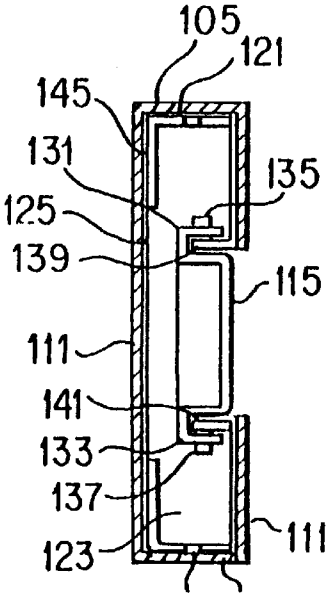

FIG. 7 shows a top perspective view of a present invention container and FIG. 8 shows a section view of FIG. 7 at E—E showing a blister pack drawer inserted in the safety container. Additional section view of FIGS. 7 and 8 are shown on FIG. 9 at F—F, FIG. 10 at G—G, and FIG. 11 at H—H which further describe the container of FIG. 7 and FIG. 12 is an end view of the container of FIG. 7. These Figures are described collectively. FIG. 7 is a perspective view of the exterior of the safety container 101 showing the housing 103; the sides 105, the open front 107 where the drawer is inserted into the container (not show in the perspective view), back 109, bottom 111, and top 113 of the housing; and latching trigger 115 operable from the exterior of the container.

FIG. 8 is section view of the perspective view of container 101 at E—E. Drawer 117 is shown fully inserted into container 103 through open front 107. Drawer 117 has front 119, bottom 125, sides 121, and back 123, with blisters 126 containing medicines or the like. Attached to the back 123 of drawer 117 are rearward supports 127 and 129 which extend to hooks 131 and 133. Hooks 131 and 133 are shown engaged with pins 135 and 137, which are supported on brackets 139 and 141 which are integral with back 109 of housing 103. Latching trigger 115 is integral with rearward supports 127 and 129 of drawer 117 connected to back 123 of the drawer. Drawer 117 also has integral triangular members 145 and 147 which support rearward extensions of sides 121 and living springs 149 and 151, which in this embodiment are shown integral with sides 121 of drawer 117. Living springs 155 and 157 are integral with rearward supports 127 and 129 of drawer 117 being thinned sections of support 127 and 129 to provide the resilient living springs needed for the second set of springs as discussed above as shown in FIG. 9 at Section F—F.

When the drawer 117 is inserted into housing 103 it is guided by top 113, bottom 111, and sides 121 of the housing as it is pushed rearward to engagement of hooks 131 and 133 with pins 135 and 137, and, acting against living springs 155 and 157, snap into engaged position with the pins. The tension of living springs 149 and 151, which are forced against back 109 of housing 103 when the hooks 131 and 133 engage pins 135 and 137, maintain engagement of the hooks and pins.

The compound motions of pushing drawer 117 inward into housing 103 and pushing latching member 115 downward into housing 103 are required to release the drawer from the housing. Pushing drawer 117 inward against living springs 149 and 151 moves hooks 131 and 133 rearward into a first nonengaged position with pins 135 and 137. Then, pushing latching member 115 downward into housing 103 causes living springs 155 and 157 in rearward supports 155 and 157 to flex moving hooks 131 and 133 downward to a second position out of engagement with pins 135 and 137 allowing the drawer 117 to be removed from housing 103.

The embodiment shown for this invention describes only one of the many living spring arrangements which can be utilized to support the drawer 17 in the housing 3, or drawer 117 into housing 103, to facilitate engagement and retention of the drawer once inserted into the housing, and to require the compound motion of pushing the drawer inward and moving the latching member for release of the drawer from the housing once engaged and retained in the housing. For example, living springs 49 and 51 could be attached to the back 9 of housing 3 or to the sides 21 of drawer 17. Also, living springs 55 and 57 could be mounted on the drawer or positioned on alternate sides, top, or back of housing 3. Also, the back 123 or the sides 121 of drawer 117 could be made flexible to provide the second set of living spring needed. Many other resilient means can be devised to accomplish the functions required for this invention without exceeding the scope of the invention.

For the purposes of this invention, male and female parts are taken to mean two or more engaging parts which can be connected to and unconnected from one another in a locking fashion. Thus, while a hook and pin are shown in the drawings representing the male and female engaging latching means parts shown in this embodiment, equivalent engaging parts such as hooks and loops, slots and sleeves, etc., could be used without exceeding the scope of the invention.

A drawer with integral blister pack is described in the drawings. However, an empty drawer into which a blister pack can be inserted for storage in the container can be used. The drawer can be marked to identify the medicine enclosed in the drawer at the open end of the container for future dispensing.

Obviously, numerous modifications and variations of the present invention are possible in light of the above teachings. It is therefore understood that within the scope of the appended claims, the invention may be practiced otherwise than as specifically described herein.

What is claimed is:

1. A child resistant safety container for a blister pack comprising;

a housing with at least one open side which positions and retains a drawer, a drawer being inserted into said at least one open side of said housing, a latching means to engage and retain said drawer when inserted into said housing, said latching means having cooperating male and female parts with one of said male and female parts located on an outside surface of said drawer and the other of said male and female parts located on the inside of said housing in a position complimentary to said outside surface of said drawer and functionally operable with said one of said male and female parts on said outside surface of said drawer, a latching trigger member slidably connected to said housing in a position to functionally connect to and actuate one of said male and female parts of said latching means located on said inside of said housing, wherein said latching means includes a first resilient means to urge said drawer into engagement with said latching means and, when said drawer is pushed in against said first resilient means, moves said latching means into a first partially disengaging position, and, wherein said latching trigger member moves said latching means against a second resilient means into a second fully disengaging position allowing said drawer to be removed from said container.

2. The safety container of claim 1 wherein said drawer is made as a blister pack for dispensing medicine and integrally contains said cooperating male and female parts of said latching means on an outside surface of said drawer and cooperates with said resilient means.

3. The safety container of claim 2 wherein said cooperating male and female parts comprise a hook and a female part selected from the group consisting of an orifice and a pin.

4. The safety container of claim 3 wherein said hook is located on said drawer and said female part is located on said housing.

5. The safety container of claim 4 wherein said safety container further includes a tamper evidencing enclosure encasing said housing.

6. The safety container of claim 3 wherein said hook is located on said housing and said female part is located on said drawer.

7. The safety container of claim 3 wherein said hook is located on said latching means and said female part is located on said drawer.

8. The safety container of claim 3 wherein said latching means includes a compound motion for release of said drawer from said safety container, including a first releasing motion being to move said hook to a position relative to said female part not engaged with the surfaces of said female part, and a second releasing motion being to move said hook out of engagement with said female part.

9. The safety container of claim 8 wherein said first releasing motion is to push said drawer into said housing against a first resilient means.

10. The safety container of claim 8 wherein said second releasing motion is to move said latching means against a second resilient means.

11. The safety container of claim 3 wherein said cooperating hook and female parts are configured to snap into engagement when said drawer is inserted into said housing of said safety container.

12. The safety container of claim 3 wherein said first resilient means is unistructurally integral with said drawer.

13. The safety container of claim 3 wherein said second resilient means is unistructurally integral with one of the group selected from said drawer and said housing.

14. The safety container of claim 1 wherein said resilient means allows said latching means to snap into engagement when said drawer is slidably inserted into said safety container.

15. The safety container of claim 1 wherein said latching means includes a compound motion for release, and includes two resilient means, and further includes a first releasing motion being to move said drawer against a first resilient means to move said latching means into a first disengaged position, and a second releasing motion being to move said latching trigger member against a second resilient means to move said latching mechanism into a second disengaged position allowing removal of said drawer from said housing.

16. The safety container of claim 15 wherein said first resilient means cooperating with said drawer is located on said drawer.

17. The safety container of claim 15 wherein said first resilient means cooperating with said drawer is located on said housing.

18. The safety container of claim 15 wherein said second resilient means cooperating with said latching means is located on said drawer.

19. The safety container of claim 15 wherein said second resilient means cooperating with said latching means is located on said housing.

20. The safety container of claim 1 wherein said cooperating male and female parts comprise a hook and a female part selected from the group consisting of an orifice and a pin.

* * * * *